US006634853B1

(12) United States Patent
Anderson

(10) Patent No.: US 6,634,853 B1
(45) Date of Patent: Oct. 21, 2003

(54) COMPACT CENTRIFUGAL COMPRESSOR

(75) Inventor: J. Hilbert Anderson, York, PA (US)

(73) Assignee: Sea Solar Power, Inc., York, PA (US)

( * ) Notice: Subject to any disclaimer, the term of this patent is extended or adjusted under 35 U.S.C. 154(b) by 0 days.

(21) Appl. No.: 10/201,266

(22) Filed: Jul. 24, 2002

(51) Int. Cl.[7] ..... F04D 25/02

(52) U.S. Cl. ..... 415/70; 415/122.1; 415/216.1; 415/231

(58) Field of Search ..... 415/122.1, 216.1, 415/230, 231, 70; 464/183, 182

(56) References Cited

U.S. PATENT DOCUMENTS 2,850,876 A * 9/1958 Wood ..... 60/805
3,418,485 A * 12/1968 Anderson et al. ..... 290/1 R
3,667,214 A * 6/1972 Addie ..... 60/608
4,209,282 A * 6/1980 Eberhardt ..... 417/251
4,622,818 A * 11/1986 Flaxington et al. ..... 60/624
5,538,649 A * 7/1996 Demendi et al. ..... 508/101

* cited by examiner

*Primary Examiner*—Ninh H. Nguyen
(74) *Attorney, Agent, or Firm*—Venable LLP; John P. Shannon

(57) ABSTRACT

In a centrifugal compressor the drive shaft of the compressor is driven by a step up gear mechanism including an input shaft driving a central drive gear, an output gear mounted on the compressor drive shaft, and three gear trains extending from the central drive gear and the output gear. Two impellers to provide two stages of compression are mounted back to back on the inner end of the compressor drive shaft. The input shaft of the gear train mechanism comprises a quill shaft surrounded by a hollow shaft fixed by friction to the inner end of the quill shaft. A rubbing seal is provided between the outer end of the hollow shaft and the compressor casing. The compressor drive shaft is supported on its outer end by the gear train mechanisms and at its middle and near its inner end by angular contact ball bearings. The portion of the compressor drive shaft between the ball bearing at the middle of the shaft and the outer end of the drive shaft is a flexible quill shaft.

23 Claims, 3 Drawing Sheets

COMPACT CENTRIFUGAL COMPRESSOR

BACKGROUND OF THE INVENTION

The present invention relates to power driven machinery, such as compressors, and, more particularly, to centrifugal compressors.

Due to the power that drives them and the need for durability, machines such as compressors tend to be heavy and bulky. The bulk involved requires that considerable space be dedicated to machines such as compressors, and it has long been desired to reduce their space requirements, not only for more advantageous use of space in buildings and the like, but also to reduce the size of the machines for purposes of shipping, maintenance, repair, etc. In the case of a compressor, for example, the output shaft from an electric motor, internal combustion engine, or the like is coupled to a drive shaft of the compressor. The drive shaft transmits power from the power source through an arrangement of gears to another shaft, on which an impeller is mounted. Very often, where more than one stage of compression is necessary, one or more additional impellers are mounted on still other shafts. All of this tends to add to the size of the compressor.

Furthermore, the input shaft to the compressor must be precisely aligned with the output shaft from the motor or the like to avoid excessive vibration, premature bearing failure and other problems. In addition, the gears tend to be noisy, and there are a number of places at which high-pressure gas from gas handling portions of the compressor can leak into areas containing the gears and other drive elements. In addition, a large seal around the input shaft has been required and, in some cases, notches in the seal, designed to prevent seals from rotating, that can lead to seal distortion as the temperature rises. Moreover, many step up gear drives employ a single stage of step up, thereby making the pitch line velocities of the gears and the gear noise level higher, and gear efficiency lower. In addition, gear size is unnecessarily large. With a single stage of gear step up, the drive shaft and the impeller shaft [input and output] must be offset, requiring more expensive machining and assembly and the windage loss of the gears traveling through the gas in the drive compartment is higher than necessary because the gear diameter is greater and the gear velocity is higher than necessary. The power windage loss from a gear is usually proportional to the fifth power of the diameter. With many shaft bearings, there tends to be some movement between bearing surfaces and the shaft such that the shaft is slightly eccentric to the bearings, which in turn increases the likelihood of significant leakage of the impeller cavity to the gear cavity.

As with all rotary machinery, particularly machinery that rotates at a high speed, vibration is an important consideration, and vibration is likely to be excessive if the critical speed of the rotor is below the operating speed of the rotor, the critical speed being the speed at which vibration begins. Each impeller develops pressure from the inside to the outside and, as a result, each impeller has a thrust force developed toward the inlet side. These thrust forces must be borne by some portion of the compressor.

SUMMARY OF THE INVENTION

By the present invention, a centrifugal compressor for air or other gases is provided which is compact and lightweight compared with known centrifugal compressors of similar capacity. In addition, the centrifugal gas compressor according to the present invention has numerous other improved characteristics, such as reduced noise and vibration, increased ease of installation, improved sealing between the gear cavity and the compressor cavity, as well as smaller and more efficient sealing between the compressor and the atmosphere. Furthermore, aspects of the compressor according to the present invention result in lower costs for machining and assembly than known compressors.

The foregoing and other advantages result from the construction of the compressor of the present invention. Misalignment of a coupling of the drive shaft of the motor, engine or the like to the drive shaft of the compressor is accommodated by the structure of the compressor shaft, including the thinness and flexibility of the compressor input shaft. The compressor input shaft is a thin quill shaft positioned within a hollow shaft so that most of the length of the hollow shaft overlaps the quill shaft. The quill shaft is fixed to the hollow shaft only at the internal ends of the quill shaft and the hollow shaft, thereby reducing the overall length of the compressor input shaft system compared to the input shaft systems of compressors in which the thin quill shaft is mounted external to the compressor. Thus, according to the present invention, the full length of the quill shaft between the coupling to the motor at one end and the attachment to the hollow shaft at the other end is available to accommodate strain and misalignment, but without increasing the length of the compressor input shaft system by the entire length of the compressor input shaft and without adversely affecting the performance of the hollow shaft.

The diameter of the thin quill shaft can be minimized because no keyways are used to connect the shaft to the coupling hub. Keyways inherently experience increased stress concentrations relative to the rest of a shaft. Therefore, shafts having keyways must be made sufficiently large in diameter to withstand the higher stresses of the keyways. A hub is mounted by friction on the outer end of the thin quill shaft, the hub being connected by a flexible coupling with the motor drive shaft. The inner end of the thin quill shaft is secured by friction in the inner end of the hollow shaft. Since the drive shaft of the compressor according to the present invention is a round shaft without keyways, the drive shaft has no increased stress concentrations in some areas. As a result, the diameter of the shaft can be made smaller. This reduces weight and permits the use of a smaller shaft seal having lower rubbing speeds, lower costs, and less friction loss.

In addition to accommodating misalignment of the coupling, the small diameter of the quill shaft allows the shaft seal between the gas in the compressor and the atmosphere to be minimized, due to the smaller diameter of the seal. The smaller diameter of the seal reduces the speed at which surfaces of the seal rub on one another and thereby reduces wear on the seal and the possibility of leakage.

Of the parts of the seal that rub on one another, it is preferred that one is carbon and that the other is silicone carbide. These materials operate together with a low coefficient of friction to reduce wear. Furthermore, the carbon seal is devoid of notches and other irregularities and, therefore, is better able to maintain its true flatness without distortion. Notches are commonly used in seals to receive complementary formations and thereby prevent the seals from rotating due to the friction between the mechanical parts. Upon the heating due to friction, the areas of the seals around the notches expand differently from other areas of the seals, thereby causing distortion of the seals. In contrast, the compressor according to the present invention includes a circular spring finger to grip the carbon seal part and thereby prevent it from rotating due to friction.

Two stages of gear ratio step up are used in the compressor according to the present invention. As a result, the pitch line velocities of the gears are much lower than the pitch line velocities of a single stage step up gear. This makes for better efficiency and a lower noise level. Furthermore, the use of a two-stage gear ratio step up enables the compressor drive shaft and the compressor impeller shaft to be coaxial, rather than offset from one another, as in a single stage gear ratio step up. The coaxial arrangement reduces the cost of machining and assembly. Furthermore, the diameters of the gears in the two-stage gear ratio step up arrangement are smaller than in a single stage arrangement, and the gear velocities are lower. As a result, the power loss due to the windage of the gears travelling through the gas surrounding the gears is much lower. The power windage loss from a gear is usually proportional to the diameter of the gear to the fifth power. Moreover, since the two-stage gear arrangement enables the drive shaft and the impeller shaft to be coaxial, the overall diameter of the compressor casing can be much smaller than would be the case where one shaft is offset from other shafts by the center distance between the gears.

The two-stage gearing of the compressor according to the present invention employs three cluster gears spaced by 120° from one another around the axis of the drive shaft. A center gear is mounted on the input shaft of the compressor and is supported by the three cluster gears. The use of the three cluster gears rather than a single offset gear means that the center gear can handle three times as much torque. As a result, the center gear need not be as large as in other arrangements, and so the size and weight of the compressor is further reduced.

The impeller shaft and all of the rotating shafts of the gears are mounted on angular contact ball bearings. These bearings are spring loaded so that they are always maintained precisely concentric with the shaft. As a result, there is less movement of the shaft eccentric to the bearings, and this reduces the possibility of much leakage of gas from the impeller cavity of the compressor into the gear cavity. The impeller shaft is supported by bearings at three points along the line of the shaft: the bearing at one end of the impeller shaft comprises the center gear on the impeller shaft being supported by the three cluster gears; a bearing adjacent the impellers directly supports the load of the impeller on the impeller shaft; and an intermediate bearing supports the middle of the impeller shaft and takes any unwanted thrust load on the shaft. In a shaft having bearings at three points along its length, it is almost impossible to get excellent results if the shaft is stiff between all three bearings. Accordingly, in the compressor according to the present invention, the portion of the impeller shaft between the cluster gears and the intermediate bearing is a small diameter quill shaft. This portion of the shaft permits relative transverse deflection of the center gear with respect to the other two bearings, which is an important factor in making the operation of a three-bearing shaft successful.

Where two impellers are used, they are mounted together, back to back, on the impeller shaft and forced tightly against one another. This arrangement permits the distance from one stage of compressor to another to be a minimum. It also permits both impellers to be positioned close to a bearing, so that both impellers are well supported, and the critical speed of the rotor can be well above the operating speed. This reduces the possibility of vibrational damage. By arranging the impellers back to back, the thrust forces tending to move each impeller toward its inlet side counteract each other, so that the net thrust from the impellers is minimized. This also enables the use of a smaller balance piston seal between the stages of the two impellers.

Inside the casing of the compressor is an internal gear housing which provides a barrier against sound emissions from the gears to the outside of the compressor. This double wall installation eliminates the transmission of much of the gear noise to the outside.

DETAILED DESCRIPTION OF THE INVENTION

Figure 1:
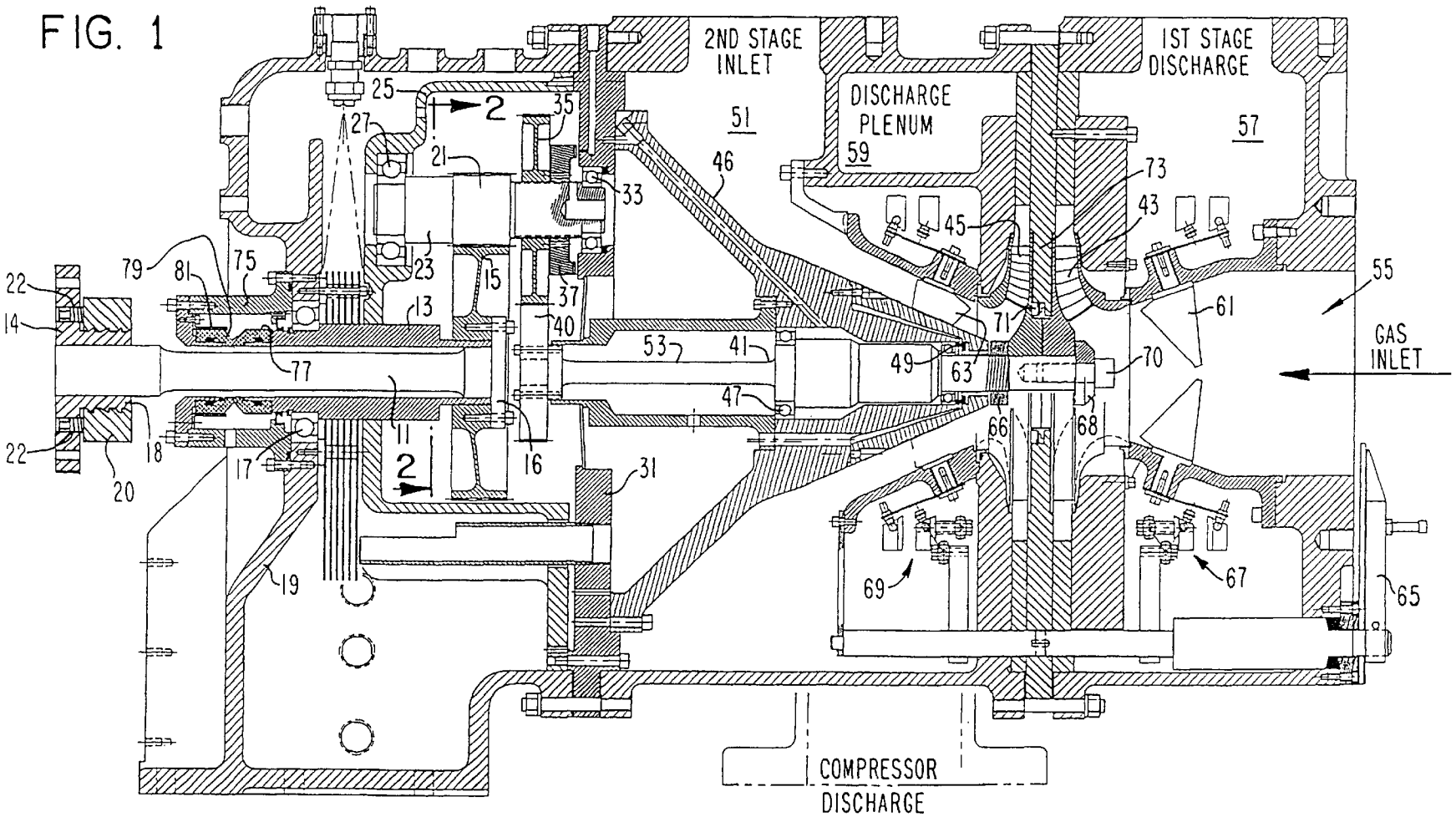
FIG. 1 is an axial sectional view of the compressor of the invention.

By the present invention, a centrifugal compressor for air or other gases is provided which is compact and lightweight compared with known centrifugal compressors of similar capacity. In addition, the centrifugal gas compressor according to the present invention has numerous other improved characteristics, such as reduced noise and vibration, increased ease of installation, improved sealing between the gear cavity and the compressor cavity, as well as improved sealing between the compressor and the atmosphere. Furthermore, aspects of the compressor according to the present invention result in lower cost for machining and assembly than known compressors.

The foregoing and other advantages result from the construction of the compressor. Misalignment of a coupling of the drive shaft of the motor, engine or the like to the drive shaft of the compressor is accommodated by the structure of the compressor shaft, including the thinness and flexibility of the compressor input shaft. The compressor input shaft is a thin quill shaft positioned within a hollow shaft so that most of the length of the hollow shaft overlaps the quill shaft received within the hollow shaft. The quill shaft is fixed to the hollow shaft only at the internal ends of the quill shaft and the hollow shaft, thereby reducing the overall length of the compressor drive shaft system compared to the input shaft systems of other compressors wherein the thin quill shaft is mounted external to the compressor. Thus, according to the present invention, the full length of the quill shaft between the coupling to the motor at one end and the attachment to the hollow shaft at the other is available to accommodate strain and misalignment, but without increasing the length of the compressor input shaft system by the entire length of the compressor input shaft and without adversely affecting the performance of the hollow shaft.

The diameter of the thin quill shaft can be minimized because no keyways are used to connect to the quill shaft at either end. Keyways inherently experience increased stress concentrations relative to the rest of a draft. Therefore, shafts having keyways must be made sufficiently large in diameter to withstand the higher stresses of the keyways. A hub is mounted by friction on the outer end of the thin quill shaft, the hub being connected by a flexible coupling to the motor drive shaft. The inner end of the thin quill shaft is secured by friction in the inner end of the hollow shaft. Since the drive shaft of the compressor according to the present invention is a round shaft without keyways, the drive shaft has no stress raisers, it has no structure which has increased stress concentrations in some areas. As a result, the diameter of the shaft can be made smaller. This reduces weight and permits the use of a smaller shaft seal with lower rubbing speeds, lower costs, and less friction loss.

In addition to accommodating misalignment of the coupling, the small diameter of the quill shaft allows the shaft seal between the gas in the compressor and the atmosphere to be minimized, due to the smaller diameter of the seal. The smaller diameter of the seal reduces the speed at which surfaces of the seal rub on one another and thereby reduces wear on the seal and the possibility of leakage.

Of the parts of the seal that rub on one another, it is preferred that one is carbon and that the other is silicone carbide. These materials operate together with a low coefficient of friction to reduce wear. Furthermore, the carbon seal is devoid of notches and other irregularities and, therefore, is better able to maintain its true flatness without distortion. Notches are commonly used in seals to receive complementary formations and thereby prevent the seals from rotating due to the friction between the mechanical parts. Upon the heating due to friction, the areas of the seals around the notches expand differently from other areas of the seals, thereby causing distortion of the seals. In contrast, the compressor according to the present invention includes a circular spring finger to grip the carbon seal part and, thereby prevent it from rotating due to friction.

Two stages of gear ratio step up are used in the compressor according to the present invention. As a result, the pitch line velocities of the gears are much lower than the pitch line velocities of a single stage step up gear. This makes for better efficiency and a lower noise level. Furthermore, the use of a two-stage gear ratio step up enables the compressor drive shaft and the compressor impeller shaft to be coaxial, rather than offset from one another, as in a single stage gear ratio step up. The coaxial arrangement reduces the cost of machining and assembly. Furthermore, the diameters of the gears in the two-stage gear ratio step up arrangement are smaller than in a single stage arrangement, and the gear velocities are lower. As a result, the power loss due to the windage of the gears travelling through the gas surrounding the gears is much lower. The power windage loss from a gear is usually proportional to the diameter of the gear to the fifth power. Moreover, since the two-stage gear arrangement enables the drive shaft and the impeller shaft to be coaxial, the overall diameter of the compressor casing can be much smaller than would be the case where one shaft is offset from other shafts by the center distance between the gears.

The two-stage gearing of the compressor according to the present invention employs three cluster gears spaced by 120° from one another around the axis of the drive shaft. A center gear is mounted on the drive shaft compressor and is supported by the three cluster gears. The use of the three cluster gears rather than a single offset gear means that the center gear can handle three times as much torque. As a result, the center gear need not be as large as in other arrangements, and so the size and weight of the compressor is further reduced.

The impeller shaft and all of the rotating shafts of the gears are mounted on angular contact ball bearings. These bearings are spring loaded so that they are always maintained precisely concentric with the shaft. As a result, there is less movement of the shaft eccentric to the bearings, and this reduces the possibility of much leakage of gas from the impeller cavity of the compressor into the gear cavity. The impeller shaft is supported by bearings at three points along the line of the shaft; the bearing at one end of the impeller shaft comprises the center gear on the impeller shaft being supported by the three cluster gears; a bearing adjacent the impellers directly supports the load of the impeller on the impeller shaft; and an intermediate bearing supports the middle of the impeller shaft and takes any unwanted thrust load on the shaft. In a shaft having bearings at three points along its length, it is almost impossible to get excellent results if the shaft is stiff between all three bearings. Accordingly, in the compressor according to the present invention, the portion of the impeller shaft between the cluster gears and the intermediate bearing is a small diameter quill shaft. This portion of the shaft permits relative transverse deflection of the center gear with respect to the other two bearings, which is an important factor in making the operation of a three-bearing shaft successful.

Where two impellers are used, they are mounted together, back to back, on the impeller shaft and forced tightly against one another. This arrangement permits the distance from one stage of compressor to another to be a minimum. It also permits both impellers to be positioned close to a bearing, so that both impellers are well supported, and the critical speed of the rotor can be well above the operating speed. This reduces the possibility of vibrational damage. By arranging the impellers back to back, the thrust forces tending to move each impeller toward its inlet side counteract each other, so that the net thrust from the impellers is minimized. This also enables the use of a smaller balance piston seal between the stages of the two impellers.

Inside the casing of the compressor is an internal gear housing which provides a barrier against sound emissions from the gears to the outside of the compressor. This double wall installation eliminates the transmission of much of the gear noise to the outside.

Figure 2:
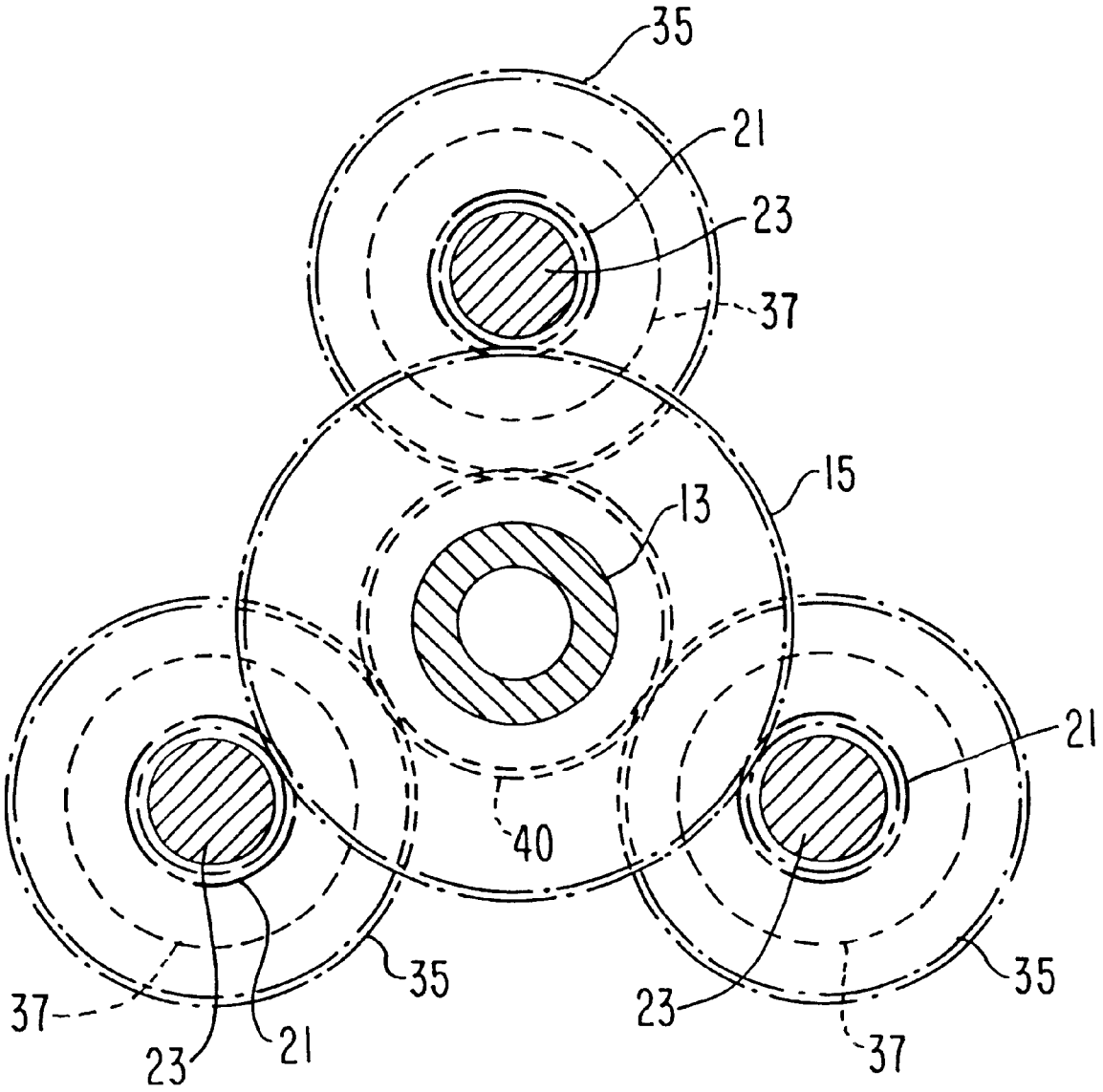
FIG. 2 is a cross sectional view of the compressor taken along line 2—2 of FIG. 1.
Figure 3:
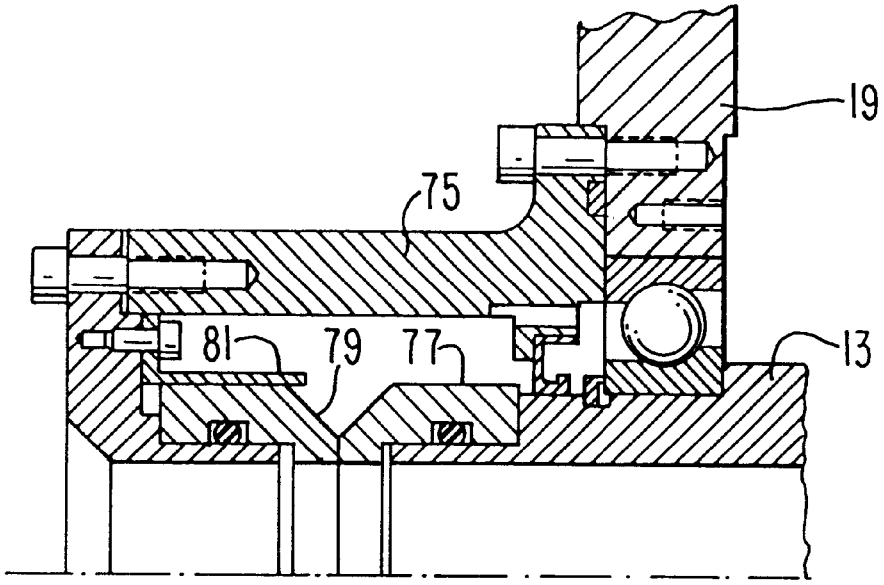
FIG. 3 is an enlarged sectional view of the rubbing seal used where the input shaft of the compressor passes through the compressor casing.

The compressor of the invention, as shown in FIGS. 1 and 2, is driven by an input shaft comprising a smooth, round, thin, flexible quill shaft 11 and a hollow shaft 13 surrounding the quill shaft 11 and fixed to the quill shaft 11 at the inner ends of the shafts 11 and 13 by a friction fit so that they rotate together. As shown in the enlarged sectional view of FIG. 3, a rubbing seal is provided between the outer end of the hollow shaft 13 and a seal housing 75 enclosing the rubbing seal and mounted on outer housing wall 19. The rubbing seal comprises a rotating cylindrical seal part 77 made of silicone carbide mounted on the outer end of the shaft 13 and a stationary cylindrical seal part 79 made of carbon mounted on the seal housing 75. The axial ends of the seal parts 77 and 79 abut against each other and form the rubbing seal which prevents gas within the housing of wall 19 from leaking out of the housing where the shaft 11 extends through the wall 19. The seal parts 77 and 79 operate with a low coefficient of friction to reduce wear. To prevent the stationary seal part 79 from being rotated by the frictional engagement with the rotating seal part 77, the stationary seal part 79 is held in place by a cylindrical spring finger piece 81 which is screwed to the seal housing 75 and resiliently engages the stationary seal part 79 to hold it in position and prevent it from rotating. The use of the spring finger piece 81 eliminates the need for notches cut into the stationary seal part to prevent rotation of the stationary seal part. The presence of such notches in conventional rubbing seals cause the seal part to distort as the temperature rises. The stationary seal part of the invention contains no notches and is therefore better able to retain its flatness without distortion.

The outer end of the shaft 11 is driven to rotate on its axis by a motor, not shown. A hub 14 is mounted on and is fixed by friction on the outer end of the shaft 11. The hub 14 comprises a split sleeve 18 which receives the outer end of the shaft 11. The outer surface of the sleeve 18 is provided with a profile thread design as disclosed in U.S. Pat. No. 5,123,772 to J. Hilbert Anderson, issued Jan. 23, 1992. A collar 20 is screwed on to the threads on the sleeve 18 and set screws 22 are screwed through the flange of the hub 14 to engage the collar 20. When the set screws are torqued, they exert an axial force on the collar 20, which via the threads on the sleeve 18 forces the sleeve radially inward to clamp the end of the shaft 11. A flexible coupling (not shown) is provided between the motor and the hub 14 to drive the shaft 11 through the hub 14. The outer end of the hollow shaft 13 is supported on ball bearing 17 in the housing wall 19. The central drive gear 15, mounted on the inner end of the shaft 13, drives a cluster of three outer pinion gears 21 distributed at 120 angular increments around the axis of the drive shaft 11. The quill shaft 11 has an integral flange 16 on its inner end. The flange 16 is bolted to the hub of the gear 15. The gears 21 support the distal end of the hollow shaft 13 through the central drive gear 15 providing the same support to the hollow shaft 13 that bearing would provide. The shaft 11 is in the form of a thin and flexible quill shaft so as to allow for any misalignment of the coupling to the drive motor and to prevent any such misalignment from affecting the performance of the hollow shaft 13 carrying the central drive gear 15. The shaft 11 has a central portion having a first diameter, enlarged portions having a second diameter greater than the first diameter, and fillets at functions between the central portion and the enlarged portions. Since the shaft 11 is in the form of a thin flexible quill shaft, it can be fixed to the hollow shaft at the inner end thereof and extend within the hollow shaft to the coupling with the drive motor. Thus, the length of quill shaft; needed to provide the desired flexibility, is incorporated internally in the compressor mechanism, thereby reducing the overall length of compressor compared to other compressors in which a quill shaft is mounted external to the compressor mechanism. The frictional mounting of the hollow shaft 13 and of the hub 14 on the quill shaft 11 eliminates the need for any keyways in the quill shaft 11. Since the quill shaft is round without any keyways, it has no stress concentrations permitting a smaller diameter shaft to be used. The small size of the quill shaft 11 makes it possible for the rubbing seal comprising seal parts 77 and 79 to be as small as possible, thereby reducing the rubbing speed of the rubbing seal, thus reducing wear and the possibility of leakage through the seal.

Since the gears 21 are distributed at equal angular positions, only one of the gears 21 is shown in FIG. 1, but each of the gears 21 is provided in an identical gear train between the input shaft and the output gear of the gear mechanism. Each pinion gear 21 is fixably mounted on and integral with the gear shaft 23, which has its proximal end supported on an inner casing 25 by ball bearing 27. The distal end of the gear shaft 23 is supported in an end wall 31 of the gear train enclosure by means of ball bearing 33. The portion of the gear shaft 23 between the ball bearing 33 and the gear 21 is threaded and an outer drive gear 35, provided with threads on an inner cylindrical surface thereof, is threadably mounted on the threads provided on the gear shaft 23. A collar 37 is also threadably mounted on the threads of the gear shaft 23 to frictionally engage the gear 35 to tighten the threads on the gear 35 against the threads on the gear shaft 23 to hold the gear 35 in a fixed angular position relative to the shaft 23 in the manner of a lock nut. Set screws are threadably mounted in each collar 37 to be screwed through the collar 37 and engage the gear 35 to further tighten the frictional engagement of the threads on the gear 35 with the threads on the shaft 23. The three outer drive gears 35 being mounted on the shafts 23, are axially aligned with the gears 21 and accordingly are distributed at 120° angular increments around the axis of the gear assembly. The gears 35 mesh with a central output gear 40 of the gear mechanism and support the output gear 40 on the axis of the gear mechanism. The output gear 40 is bolted to an impeller drive shaft 41 which drives the impellers 43 and 45 of the compressor. The outer end of the drive shaft 41 is supported on the axis of the gear mechanism by the output gear 40 and the gears 35 to support the outer end of the shaft 41 through the output gear 40 in a manner similar to a bearing.

The gear train mechanism provides a step up in the rotational speed in two stages, the first stage being from the central drive gear 15 to the pinion gears 21 and the second step-up being from the gears 35 to output gear 40. The use of two stages reduces pitch line velocities compared to single stage step-up gear mechanisms. In a single stage gear mechanism, the windage loss of the gear traveling through the enveloping gas is much higher than the windage loss for a two-stage gear mechanism because in a two-stage gear mechanism, the gear diameters are smaller, and the gear velocities are lower. The power windage loss from a gear is usually proportional to the fifth power of the gear diameter. Thus a greater efficiency is achieved with a two-stage gear mechanism and also the noise level is reduced. In addition, the two-stage gear train enables the impeller drive shaft 41 to be aligned with the input shaft 11 and the hollow shaft 13. This arrangement reduces the cost of machining and assembly. With the impeller drive shaft 41 coaxial with the input shaft 11, the overall size of the casing can be made much smaller, thus providing a more compact compressor design.

The two step-up stages in gear mechanism makes it possible to drive the output gear 40 from the input gear 15 through three gear trains each of which shares the torque load transmitted to the output gear. This arrangement enables the drive gear 15 and the output gear 40 to handle three times torque compared to an arrangement with only one gear train between the input gear and the output gear. As a result the size of gears in the gear mechanism can be greatly reduced.

Mounted on the end wall 31 is a conical wall 46 which supports the middle and the inner end of the drive shaft 41 with ball bearings 47 and 49. The end wall 31 and the conical wall 46 together separate the space in which the gear mechanism is housed from the chamber 51 of the compressor which receives compressed air from the first stage of the compressor provided by the impeller 43 and provides the compressed air to the inlet of the second stage of the compressor provided by the impeller 45. As described above, the gear mechanism comprising the drive gear 15, the pinion gears 21, the gears 35 and the output gear 40 are all mounted within an inner casing 25 within an outer housing wall 19. This double wall construction comprises a sound barrier and reduces the amount of gear tooth noise transmitted to the environment around the compressor.

As indicated above, the shaft 41 is in effect supported by three bearings comprising the ball bearings 47 in the middle and 49 on the inner end of the shaft 41, and the bearing function provided by the gears 35 meshing with the gear 40. The bearing 47 supports the middle of the drive shaft 41 and supports the shaft against any unwanted thrust load. Bearing 49 supports the inner end of the drive shaft 41 and is the direct support for the impellers 43 and 45. With a shaft supported in three places by bearings, like the shaft 41 is supported, it is almost impossible to get excellent results if the shaft is stiff between the three bearings. In accordance with the present invention, the portion 53 of the shaft 41 between the bearing 47 and the outer end of the shaft 41 is made in the form of a small diameter flexible quill shaft, which permits transverse deflection of the gear 40 with respect to the ball bearings 47 and 49. This flexibility provided by the quill shaft portion 53 is an important factor in making the shaft supported by the three bearings operate successfully. The portions of the shaft 41 between the ball bearings 47 and 49 as well as between the bearing 49 and the inner end of the shaft 41 where impellers 43 and 45 are mounted on the shaft 41 do not need the degree of flexibility provided by the quill portion 53 of the shaft and have greater diameters than quill portion 53 to centrally support the impellers 43 and 45 with greater strength.

All of the ball bearings 17, 27, 33, 47, and 49 are angular contact ball bearings. These bearings are spring loaded so that they are always maintained perfectly concentric with the shafts that they support. Accordingly there is less movement of the shafts eccentric to the ball bearings. This feature in the ball bearings 47 and 49, supporting the compressor drive shaft 41, reduces the possibility of leakage from the second stage inlet chamber 51 into the cavity containing the gear train mechanism.

The first stage impeller 43, which is mounted on the inner end of the shaft 41, receives gas through the gas inlet 55 and discharges the gas as compressed gas into the first stage discharge chamber 57 through a diffusing passage. The first stage discharge chamber 57 is connected by piping (not shown) to the second stage inlet chamber 51 to transmit the compressed gas from the discharge chamber 57 into the second stage inlet chamber 51. The impeller 45 further compresses the gas and discharges the second stage compressed gas into discharge plenum 59. The direction of flow of the inlet gas into the first stage impeller 43 is controlled by adjustable vanes 61 and the direction of flow of the compressed gas from the second stage inlet chamber into the second stage impeller 45 is controlled by adjustable vanes 63. The positioning of the vanes 61 and 63 is controlled by handle 65 through mechanisms 67 and 69.

The impellers 43 and 45 are mounted back to back closely adjacent to one another on the inner end of the drive shaft 41 and are axially held in position between a collar 66 threaded onto the shaft 41 and a cap 68 mounted on the end of the shaft 41 by means of bolt 70 screwed axially into the shaft 41. By having the impellers mounted together abutting each other on the shaft 41, a number of advantages are obtained. The back-to-back arrangement permits a minimum distance from one stage to the other and enables the impellers to be closely mounted on and well supported by the shaft 41. This feature causes the critical speed of the rotor to be well above the operating speed of the compressor, thus reducing the possibility of vibrational damage to the compressor.

Because the impeller 43 draws gas from the inlet end of the compressor and discharges the compressed gas radially outward, the impeller 43 develops a thrust toward the gas inlet 55. On the other hand, the impeller 45 drawing gas from the second stage inlet chamber 51 and discharging compressed gas radially outward, develops a thrust in the opposite direction toward the gear mechanism. Thus, the thrust forces developed by the two impellers counteract each other. Because the thrust developed by the two impellers counteract each other, a smaller balance piston seal 71 between the two impellers is made possible. The balance piston seal 71 is located between the two impellers where they overlap wall 73, which separates the first stage discharge chamber 57 from the discharge plenum 59. Since a smaller balance piston seal is used, there is less leakage loss from one stage to the next through the balance piston seal.

Figure 4:
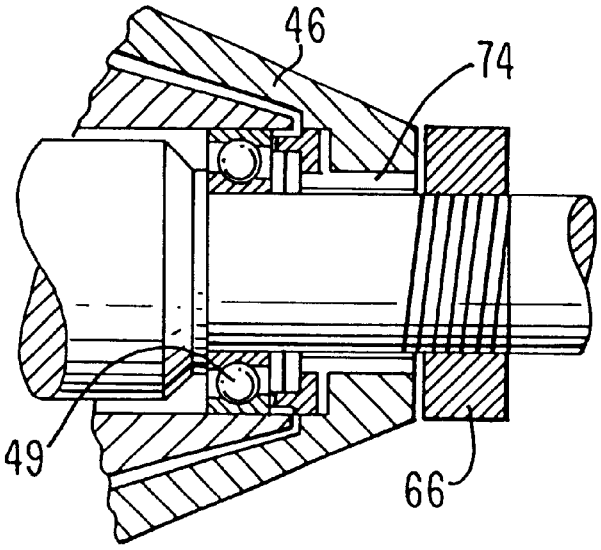
FIG. 4 is an enlarged sectional view showing a seal on the drive shaft of the compressor between the input gear mechanism cavity and a cavity containing gas compressed by the compressor.

With the compressor designed as described above the only place that compressed gas can leak from the compressor into the space in which the gear mechanism driving the shaft 41 is located is along the shaft 41. To prevent such leakage, a seal 74 is provided between the innermost end of the conical housing wall 46 and the portion of the shaft 41 between the collar 66 and the ball bearing 49. As shown in the enlarged sectional view of FIG. 4, the inner end of the conical housing wall 46 is provided with an inwardly facing cylindrical surface and a close-fitting seal 74 is provided between the cylindrical surface of the housing wall 46 and the shaft 41 between the collar 66 and the ball bearing 49. This seal 74 fits very closely to the impeller shaft and since this is the only leakage spot where compressed gas can leak into the gear cavity, any such leakage is minimized. Any leakage that does occur is vented from the gear cavity back to the suction end of the compressor through a piping connection not shown.

Because of the features employed in the compressor of the invention as described above, the compressor is compact, has a small footprint, and is light in weight compared to compressors of the prior art. In addition, the compressor is less noisy than prior art compressors and has a critical speed of rotation well above the compressor operating speed.

It will be apparent to those skilled in the art and it is contemplated that variations and/or changes in the embodiments illustrated and described herein may be made without departure from the present invention. Accordingly, it is intended that the foregoing description is illustrative only, nor limiting, and that the true spirit and scope of the present invention will be determined by the appended claims.

What is claimed as new and desired to be protected by Letters Patent of the United States is:

1. A compact centrifugal compressor, comprising:

a drive arrangement including a compressor input shaft; and an impeller driven by said compressor input shaft, wherein said compressor input shaft has a central portion having a first diameter, enlarged portions having a second diameter greater than said first diameter, and fillets at junctions between the central portion and the enlarged portions, wherein said compressor input shaft is flexible in at least a portion of the range of forces the compressor input shaft experiences during operation of the compressor, and wherein said compressor input shaft is devoid of indentations of a size on the order of size of a keyway, whereby the diameter of the compressor input shaft needed to drive the compressor is minimized.

2. The compact centrifugal compressor of claim 1, wherein the compressor has a center, said drive arrangement further includes a hollow shaft, each of said compressor input shaft and said hollow shaft has an inner end adjacent to the center of the compressor and an outer end distal to the center of the compressor, and said compressor input shaft is connected to said hollow shaft at said inner ends.

3. The compact centrifugal compressor of claim 2, further comprising a casing enclosing the impeller and the inner ends of the compressor input shaft and the hollow shaft.

4. The compact centrifugal compressor of claim 3, wherein the casing encloses all of the hollow shaft.

5. The compact centrifugal compressor of claim 3, wherein the casing encloses most of the compressor input shaft.

6. A compact centrifugal compressor having a center, comprising:

a drive arrangement including a compressor input shaft;

a hollow shaft; and an impeller driven by said compressor input shaft, wherein each of said compressor input shaft and said hollow shaft has an inner end adjacent to the center of the compressor and an outer end distal to the center of the compressor, wherein said compressor input shaft is connected to said hollow shaft at said inner ends, wherein the connection of said compressor input shaft to said hollow shaft is a keyless friction fit connection, wherein said compressor input shaft is flexible in at least a portion of the range of forces the compressor input shaft experiences during operation of the compressor, and wherein said compressor input shaft is devoid of indentations of a size on the order of size of a keyway, whereby the diameter of the compressor input shaft needed to drive the compressor is minimized.

7. A compact centrifugal compressor having a center, comprising:

a drive arrangement including a compressor input shaft;

a hollow shaft;

an impeller driven by said compressor input shaft, wherein each of said compressor input shaft and said hollow shaft has an inner end adjacent to the center of the compressor and an outer end distal to the center of the compressor, and said compressor input shaft is connected to said hollow shaft at said inner ends;

a casing enclosing the impeller and the inner ends of the compressor input shaft and the hollow shaft; and a seal within the casing, the seal extending from the casing to the hollow shaft and having a first part secured to the casing and a second part secured to the hollow shaft, the first and second parts being movable relative to one another and contacting one another to effect the seal, wherein said compressor input shaft is flexible in at least a portion of the range of forces the compressor input shaft experiences during operation of the compressor, and wherein said compressor input shaft is devoid of indentations of a size on the order of size of a keyway, whereby the diameter of the compressor input shaft needed to drive the compressor is minimized.

8. The compact centrifugal compressor of claim 7, wherein one of said first and second parts is made of carbon, and the other of said first and second parts is made of silicone carbide.

9. The compact centrifugal compressor of claim 7, further comprising a resiliently biased member fixed to said casing, the resiliently biased member resiliently contacting said first part of said seal to prevent said first part from rotating.

10. The compact centrifugal compressor of claim 9, wherein said first part of said seal is devoid of indentations adapted to receive a stationary element to prevent rotation of said first part, whereby distortion of said first part upon heating is avoided.

11. A compact centrifugal compressor having a center, comprising:

a drive arrangement including a compressor input shaft;

a hollow shaft;

an impeller driven by said compressor input shaft, wherein each of said compressor input shaft and said hollow shaft has an inner end adjacent to the center of the compressor and an outer end distal to the center of the compressor, and said compressor input shaft is connected to said hollow shaft at said inner ends;

a casing enclosing the impeller and the inner ends of the compressor input shaft and the hollow shaft; and a ball bearing secured to said casing and to said hollow shaft to support the hollow shaft for rotation relative to the casing, the ball bearing being a spring loaded angular contact bearing, wherein said compressor input shaft is flexible in at least a portion of the range of forces the compressor input shaft experiences during operation of the compressor, and wherein said compressor input shaft is devoid of indentations of a size on the order of size of a keyway, whereby the diameter of the compressor input shaft needed to drive the compressor is minimized.

12. A compact centrifugal compressor having a center, comprising:

a drive arrangement including a compressor input shaft;

a hollow shaft;

an impeller driven by said compressor input shaft, wherein each of said compressor input shaft and said hollow shaft has an inner end adjacent to the center of the compressor and an outer end distal to the center of the compressor, and said compressor input shaft is connected to said hollow shaft at said inner ends; and a casing enclosing the impeller and the inner ends of the compressor input shaft and the hollow shaft, wherein the casing has a gear cavity containing gears for rotating the impeller and a compressor cavity containing the impeller, wherein there is only one opening between the gear cavity and the compressor cavity, wherein said only one opening is closed by an impeller drive shaft on which said impeller is mounted and by a seal surrounding said impeller drive shaft, wherein said compressor input shaft is flexible in at least a portion of the range of forces the compressor input shaft experiences during operation of the compressor, and wherein said compressor input shaft is devoid of indentations of a size on the order of size of a keyway, whereby the diameter of the compressor input shaft needed to drive the compressor is minimized.

13. A compact centrifugal compressor having a center, comprising:

a drive arrangement including a compressor input shaft;

a hollow shaft;

an impeller driven by said compressor input shaft, wherein each of said compressor input shaft and said hollow shaft has an inner end adjacent to the center of the compressor and an outer end distal to the center of the compressor, and said compressor input shaft is connected to said hollow shaft at said inner ends.

a casing enclosing the impeller and the inner ends of the compressor input shaft and the hollow shaft; and a central drive gear fixed on the inner end of the hollow shaft; and at least three gear shafts parallel to said hollow shaft, said gear shafts being mounted for rotation in the compressor around the circumference of the central hollow shaft gear, a first gear positioned on each of said gear shafts, each of said first gears engaging with and supporting said central drive gear, whereby the amount of torque that can be transmitted by a central drive gear to the impeller is greater than the torque that can be transmitted by such a central drive gear to the impeller via a single gear engaging the central drive gear, wherein said compressor input shaft is flexible in at least a portion of the range of forces the compressor input shaft experiences during operation of the compressor, and wherein said compressor input shaft is devoid of indentations of a size on the order of size of a keyway, whereby the diameter of the compressor input shaft needed to drive the compressor is minimized.

14. A compact centrifugal compressor having a center, comprising:

a drive arrangement including a compressor input shaft;

a hollow shaft;

an impeller driven by said compressor input shaft, wherein each of said compressor input shaft and said hollow shaft has an inner end adjacent to the center of the compressor and an outer end distal to the center of the compressor, and said compressor input shaft is connected to said hollow shaft at said inner ends;

a central drive gear fixed on the inner end of the hollow shaft; and at least three gear shafts parallel to said hollow shaft, said gear shafts being mounted for rotation in the compressor around the circumference of the central drive gear, a first gear positioned on each of said gear shafts, each of said first gears engaging with and supporting said central drive gear, whereby the amount of torque that can be transmitted by a central drive gear to the impeller is greater than the torque that can be transmitted by such a central drive gear to the impeller via a single gear engaging the central drive gear, a casing enclosing the impeller and the inner ends of the compressor input shaft and the hollow shaft; and wherein said compressor input shaft is flexible in at least a portion of the range of forces the compressor input shaft experiences during operation of the compressor, and wherein said compressor input shaft is devoid of indentations of a size on the order of size of a keyway, whereby the diameter of the compressor input shaft needed to drive the compressor is minimized.

15. A compact centrifugal compressor, comprising:

a drive arrangement including a compressor input shaft;

an impeller driven by said compressor input shaft;

an impeller drive shaft axially aligned with said compressor input shaft, said impeller being mounted on said impeller drive shaft, wherein at least a portion of said impeller drive shaft is flexible in at least a portion of the range of forces the impeller drive shaft experiences during operation of the compressor, wherein said compressor input shaft is flexible in at least a portion of the range of forces the compressor input shaft experiences during operation of the compressor, and wherein said compressor input shaft is devoid of indentations of a size on the order of size of a keyway, whereby the diameter of the compressor input shaft needed to drive the compressor is minimized.

16. The compact centrifugal compressor of claim 15, further comprising a step up gear arrangement connecting said compressor input shaft to said impeller drive shaft, said step up gear arrangement having two stages of step up in rotational speed.

17. The compact centrifugal compressor of claim 16, further comprising a central output gear fixed on an input end of said impeller drive shaft; and at least three gear shafts parallel to said impeller drive shaft, said gear shafts being mounted for rotation in the compressor around the circumference of the central impeller drive shaft gear, an outer drive gear positioned on each of said gear shafts, each of said outer drive gears engaging with and supporting said central output gear, whereby the amount of torque that can be received by a central output gear from the compressor input shaft is greater than the torque that can be received by such a central output gear from the compressor input shaft via a single gear engaging the central output gear.

18. The compact centrifugal compressor of claim 17, further comprising a central drive gear mounted around said compressor input shaft;

a first gear positioned on each of said gear shafts, each of said first gears engaging with and supporting said central drive gear, whereby the amount of torque that can be transmitted by a central drive gear to the impeller is greater than the torque that can be transmitted by such a central drive gear to the impeller via a single gear engaging the central drive gear.

19. A centrifugal compressor comprising an impeller drive shaft, at least one impeller mounted on said drive shaft near an inner end of said drive shaft and arranged to receive inlet gas and compress said inlet gas, a mechanism connected to rotationally drive said drive shaft to rotate said impeller, a first bearing supporting said drive shaft near said impeller, and a second bearing supporting said drive shaft near the middle of said drive shaft, said drive shaft comprising a flexible quill shaft portion between said second bearing and an outer end of said drive shaft, said drive shaft having portions larger in diameter than said quill shaft between said second bearing and the inner end of said drive shaft.

20. A centrifugal compressor as recited in claim 19 wherein two impellers are mounted on said drive shaft at the inner end thereof, a first one of said two impellers for compressing gas received through a gas inlet and said second impeller arranged to further compress the gas compressed by said first impeller.

21. A centrifugal compressor as recited in claim 20 wherein said first and second impellers are mounted back to back on said drive shaft and wherein said second impeller further compresses said gas compressed by said first impeller from a second inlet stage flowing to said second impeller from the opposite direction that gas flows from said gas inlet to said first impeller whereby thrusts are generated by said impellers on said drive shaft in opposite directions.

22. A centrifugal compressor as recited in claim 19 wherein said mechanism comprises an input shaft adapted to be rotationally driven about its axis, and a gear train for driving said drive shaft from said input shaft at a stepped-up rate of rotation from the rate of rotation of said input shaft.

23. A centrifugal compressor comprising an input shaft, an impeller, a gear mechanism driving said impeller from said input shaft, a casing enclosing said gear mechanism, a rubbing seal between said input shaft and said casing, said rubbing seal comprising a rotating portion fixed to said input shaft and a fixed portion mounted on said casing and making a rubbing connection with said rotating portion, and a resilient element mounted on said casing and resiliently engaging said fixed portion to hold said fixed portion in position and prevent it from being rotated by the rubbing engagement with said rotating portion, wherein said input shaft comprises a hollow outer shaft and a thin inner shaft fixed to said hollow outer shaft at the inner ends of said inner shaft and said outer shaft said rotating portion of said rubbing seal being mounted on said hollow outer shaft.

* * * * *